US006969294B2

(12) United States Patent
Vicentelli

(10) Patent No.: US 6,969,294 B2
(45) Date of Patent: Nov. 29, 2005

(54) ASSEMBLY OF MODULES WITH MAGNETIC ANCHORAGE FOR THE CONSTRUCTION OF STABLE GRID STRUCTURES

(76) Inventor: Claudio Vicentelli, Localitá la Scaletta, 07041 Alghero (SS) (IT)

( * ) Notice: Subject to any disclaimer, the term of this patent is extended or adjusted under 35 U.S.C. 154(b) by 0 days.

(21) Appl. No.: 10/398,762

(22) PCT Filed: Dec. 27, 2001

(86) PCT No.: PCT/EP01/15343

§ 371 (c)(1),
(2), (4) Date: Apr. 10, 2003

(87) PCT Pub. No.: WO02/055168

PCT Pub. Date: Jul. 18, 2002

(65) Prior Publication Data

US 2004/0077258 A1 Apr. 22, 2004

(30) Foreign Application Priority Data

Jan. 9, 2001 (IT) ..... MI200100010

(51) Int. Cl.[7] ..... A63H 33/04; A63H 33/26
(52) U.S. Cl. ..... 446/92; 446/129
(58) Field of Search ..... 446/92, 129–139, 446/168; 273/155, 157

(56) References Cited

U.S. PATENT DOCUMENTS

| | | | | | |
|---|---|---|---|---|---|
| 2,872,754 | A | * | 2/1959 | Cronberger | 446/92 |
| 3,196,579 | A | * | 7/1965 | Lepper | 446/92 |
| 3,254,440 | A | * | 6/1966 | Duggar | 446/92 |
| 3,998,004 | A | * | 12/1976 | Ehrlich | 446/92 |
| 4,462,596 | A | * | 7/1984 | Yamamoto | 273/239 |
| 4,822,283 | A | * | 4/1989 | Roberts | 434/171 |
| 5,411,262 | A | * | 5/1995 | Smith | 273/157 R |
| 5,651,715 | A | * | 7/1997 | Shedelbower | 446/137 |
| 5,746,638 | A | * | 5/1998 | Shiraishi | 446/92 |
| 6,024,626 | A | * | 2/2000 | Mendelsohn | 446/92 |
| 6,116,979 | A | * | 9/2000 | Weber | 446/92 |
| 6,431,936 | B1 | * | 8/2002 | Kiribuchi | 446/92 |
| 6,566,992 | B1 | * | 5/2003 | Vicentelli | 335/306 |

FOREIGN PATENT DOCUMENTS

| | | |
|---|---|---|
| DE | 36 28 860 | 3/1988 |
| DE | 39 10 304 | 10/1990 |
| FR | 2 153 792 | 5/1973 |
| WO | WO 99/60583 | 11/1999 |

* cited by examiner

*Primary Examiner*—Derris H. Banks
*Assistant Examiner*—Faye Francis
(74) *Attorney, Agent, or Firm*—Young & Thompson

(57) ABSTRACT

In an assembly of modules with magnetic anchorage for the construction of grid structures, one or more elements for stabilization of the grid structure are inserted in the form of panels (6, 12, 6") which can be removably slotted in corresponding polygonal areas circumscribed by the modules of the grid structure.

18 Claims, 1 Drawing Sheet

ASSEMBLY OF MODULES WITH MAGNETIC ANCHORAGE FOR THE CONSTRUCTION OF STABLE GRID STRUCTURES

BACKGROUND OF THE INVENTION

The present invention relates to an assembly of modules that uses magnetic anchorage for the construction of a stable grid structure.

From the Italian patent no. 01301090, owned by the same Applicant, an assembly of modules is known which optimizes the exploitation of magnetic energy available for the anchorage of the modules in such a way as to achieve a plurality of grid structures having the most complex and inventive shapes.

The point of magnetic coupling between two modules can be chosen as required at any one of the zones of the magnetically active surface and/or ferromagnetic surface of one of the modules and is not limited by a predefined orientation between the two modules in such a way that the modules of the assembly can be combined overall one with the other, obtaining a plurality of shapes.

In all systems of assembly with magnetic anchorage known today, and above all in those assemblies with magnetic anchorage which under-exploit the magnetic energy available for anchorage between modules, some shapes of the grid structure do not have the appropriate stability and self-support capability, particularly with reference to resistance to shearing or slipping and to bending stress.

In these cases the shape of the original grid structure has to be modified by adding thereto other appropriate modules to ensure its stability.

This solution, in addition to modifying the original shape of the required grid structure, can cause excessive increase in the weight and cost of the same grid structure.

SUMMARY OF THE INVENTION

The main object of the present invention is to provide an assembly of modules with magnetic anchorage for the construction of grid structures that, through the use of a same number of magnetic modules, achieve an improved resistance to the deformation caused by shearing, slipping, bending or torsion stresses. Another object of the present invention is to provide an assembly of modules with magnetic anchorage for the construction of grid structures which makes any required grid structure stable without it being necessary to modify its shape and excessively increase its weight or total cost.

These objects are achieved by an assembly of modules with magnetic anchorage for the construction of grid structures which is characterized in that the assembly includes one or more stabilization elements in the grid structure, in the form of panels which are removably inserted in corresponding polygonal areas circumscribed by the modules of the grid structure.

The panels can be made in a lightweight and economical material and enable extremely stable grid structures to be obtained, while maintaining the original simplicity and flexibility of assembly of the modules.

The panels for stabilisation of the grid structure can also allow new ways of using grid structures both as elements strictly for amusement and as display or furnishing elements.

These aspects will be made clearer on reading the following description of some preferred embodiments of the invention, to be considered merely by way of a non-limiting example of the more general principle claimed.

BRIEF DESCRIPTION OF THE DRAWINGS

The following description refers to the accompanying drawings, in which.

DESCRIPTION OF THE PREFERRED EMBODIMENTS

Figure 1:
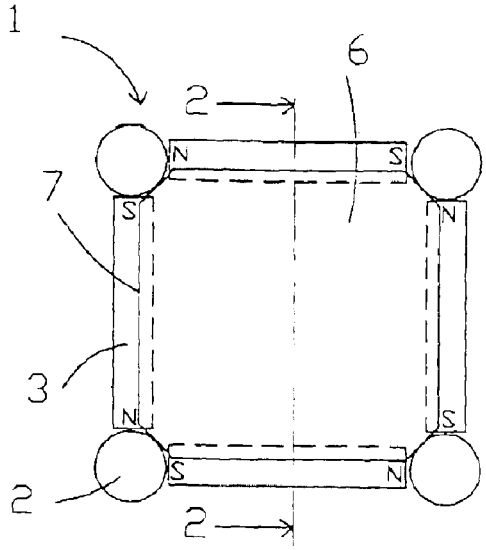
FIG. 1 is a side elevation view of an assembly of modules with magnetic anchorage defining a two-dimensional structure in accordance with a first preferred embodiment of the present invention.
Figure 2:
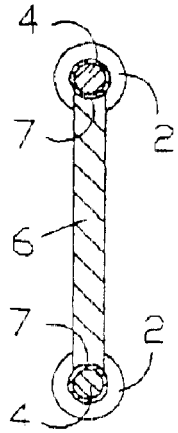
FIG. 2 is a cross-sectional view taken along line 2—2 of FIG. 1.
Figure 3:
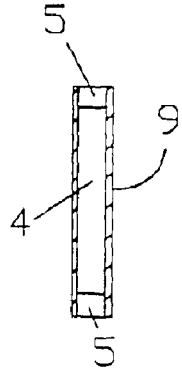
FIG. 3 is a partially sectioned detailed view of the structure of a cylindrical module used in the present invention.

With reference to FIGS. 1, 2 and 3, a two-dimensional assembly 1 of eight modules comprising four spherical modules 2 and four cylindrical modules 3 is illustrated.

The spherical modules 2 consist of a ferromagnetic ball member for example of steel, while the cylindrical modules 3 each comprises a central ferromagnetic cylindrical yoke 4 to each of whose opposite ends a corresponding cylindrical element 5 of permanently magnetic material is provided.

The permanently magnetic elements 5 are magnetized axially and are arranged with the ends of opposite magnetic polarity in such a way as to be connected in series via the ferromagnetic yoke 4.

If necessary the structure of the cylindrical modules 3 can be contained in a non-magnetic covering matrix 9.

The assembly 1 comprises a square plaque or panel 6 with cut-away corners which defines, in the direction of the thickness of the panel 6, lateral recessed edges 7 with an arched cross profile.

The radius of curvature of the four edges of the panel 6 is equal to the radius of the cylindrical modules 3.

As can be seen, the assembly consists of four cylindrical modules 3 disposed in a square arrangement and of four spherical modules 2 arranged at the corners of the square in contact with the end bases of the two cylindrical modules 3 which converge therein.

The cylindrical modules 3 are oriented in such a way that the magnetic tensions caused thereby in the magnetic circuit formed by the-assembly are all combined in series.

Before finishing the assembly with the fourth and final cylindrical module 3, the panel 6 is inserted in the plane zone defined by the remaining three cylindrical modules 3 until each edge of the panel 6 is slotted on the lateral wall of a corresponding cylindrical module 3.

After insertion of the panel 6 the last cylindrical module 3 is slotted in the side of the remaining free side of panel 6 to complete the assembly.

Clearly the panel 6, although leaving the flexibility of assembly of the modules unchanged, acts in the sense that it stiffens the assembly and allows it to maintain its shape even where there is shearing or torsional stress, and at the same time can act as a surface for supporting a weight.

The panel 6 can be in colored or natural plastic material or wood, in lightweight metal or in any other lightweight and economical material yet sufficiently resistant from the mechanical standpoint.

The panel 6 is removably fitted between the cylindrical modules 3 and can naturally be reused as required for the creation of new and different assemblies.

The assembly of FIG. 1 can form the basis for the construction of definitely more complex three-dimensional grid structures.

Figure 4:
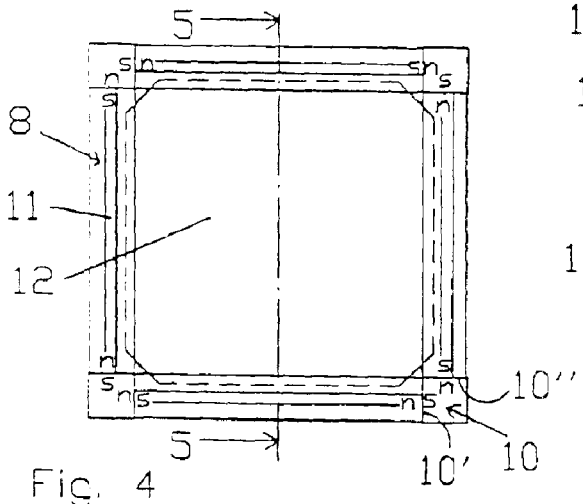
FIG. 4 is a side elevation view of an assembly of modules with magnetic anchorage defining a two-dimensional structure in accordance with a second preferred embodiment of the present invention.
Figure 5:
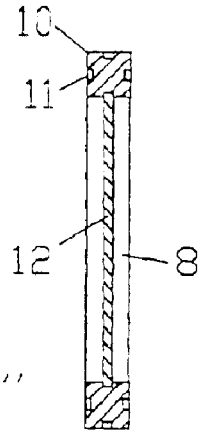
FIG. 5 is a cross-sectional view taken along line 5—5 of FIG. 4.

Referring now to FIGS. 4 and 5, an assembly of modules is illustrated for the construction of a structure similar to that of FIG. 1 but with modules having a different shape and structure.

In this case the spherical ferromagnetic modules 2 forming the corners of the square structure are replaced with permanently magnetic cubic modules 10 having two adjacent faces 10' and 10" with opposite magnetic polarity, while the cylindrical modules 3 forming the sides of the square structure are replaced by modules 8 which are structurally identical but in the form of a parallelepiped with a square cross-section.

In this case, the system of removably slotting between the panel 12 and the modules 8, although still of the male/female type, is made in a different way by forming rectangular grooves 11 with width equal to the thickness of the panel 12 along the longitudinal median axes of each of the four lateral faces of the parallelepiped modules 8.

Naturally other forms of removable slotting of the panels in modules other than those shown here can be provided without departing from the principle claimed. Obviously the number and points of positioning the stabilization panels in a more complex grid structure can be varied as required by the person constructing it.

In order to adapt to the various possible shapes of the areas defined by the modules forming a grid structure, the panel can also have in turn a triangular, rectangular, pentagonal or generically polygonal shape.

The present principle must be also be considered extended to the cases wherein the modules of the assembly are different in terms of shape, structure and dimensions from those shown hitherto, but such as to create in any case a grid structure. Modules extending along a preferential axis, for example straight prisms or cylinders with a generically polygonal base, will preferably be used, alone or combined with modules without a preferential extension axis, for example cubes or spheres, and slotting will take place between a panel and the modules extending along a preferential axis, that define a polygonal area of the grid structure.

All the modules and the procedure for assembly of the modules illustrated in the Italian patent no. 01301090 can advantageously be used.

In particular, the modules which create the grid structure can thus be modules of a first type, consisting of at least one active magnetic element, that is to say an element which has two surfaces of opposite polarity, at least one ferromagnetic element and possibly a non-magnetic covering matrix, or modules of the first type combined with modules of a second type, the latter consisting of a ferromagnetic element possibly inserted in a non-magnetic covering matrix.

The modules are assembled in such a way that the magnetic flow generated by the active magnetic elements used in the anchorage closes totally or at least partially via the ferromagnetic parts of the grid structure, and in such a way that the magnetic tensions produced in the magnetic circuit generated by the active magnetic elements which achieve anchorage are combined in series.

Figure 6:
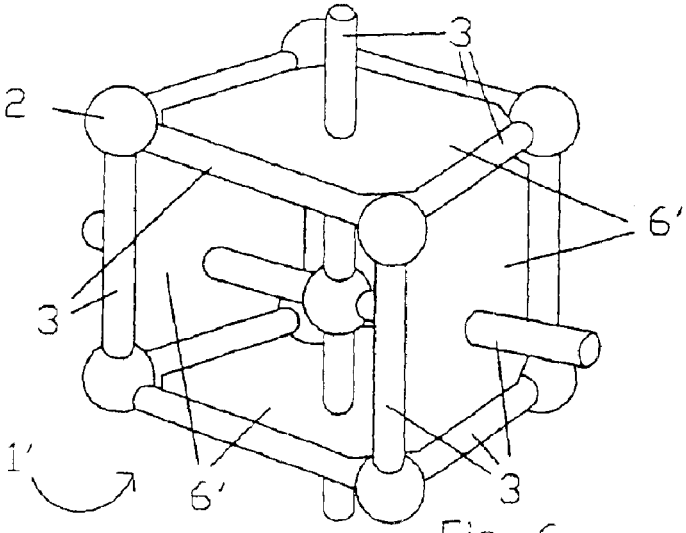
FIG. 6 is a perspective view of an assembly of modules with magnetic anchorage defining a three-dimensional structure in accordance with a further preferred embodiment of the present invention.

FIG. 6 shows a three-dimensional assembly made with spherical modules 2 and cylindrical modules 3 identical to those described with reference to FIGS. 1, 2 and 3.

In this example of assembly 1', which represents a model of a cubic grid of a crystal type with a centered body, the panels 6' have a hole in the center which allows a cylindrical module 3, inserted through it, to be supported. The presence of at least three panels in three corresponding orthogonal faces of the cubic structure prevents deformation of the structure caused by application of a bending or shearing action thereon. If preservation of the deformability of the structure in one of its main directions is required, it will be sufficient to eliminate from the structure the panel arranged in the plane wherein deformation is to be produced.

The panels can improve the recreation potential of the grid structure to be constructed, as they can for example depict portions of a picture of a three-dimensional puzzle.

The panels can also act as explanatory or advertising boards, in addition to allowing the creation of closed, half-closed or open volumes, which can be used according to the most widely varying needs of furnishing, support, containing or other purposes.

Figure 7:
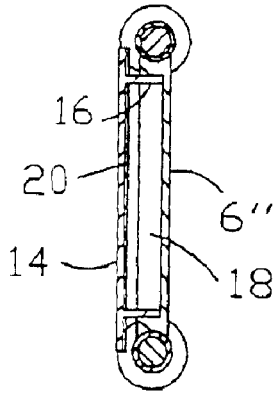
FIG. 7 is a cross-sectional view of a grid structure similar to that of FIGS. 1 and 2, wherein a different structure of display panel is provided.

A particularly advantageous panel structure in accordance with the present invention provides a main panel which can be removably combined with a panel cover mounted above the main panel, which panel cover extends beyond the edges of the corresponding main panel to increase the covered portion of the modules circumscribing the polygonal area wherein the main panel is attached. This aspect of the present invention is illustrated in FIG. 7, where the main square panel 6" is combined with a panel cover 14, in this case square and transparent, which protrudes beyond the edges of the main panel 6" until it covers almost half the upper lateral surface of the cylindrical modules between which it is inserted.

The panel cover 14 has feet 16 at the four corners which can be press-fitted in a housing cavity 18 formed on the body of the main panel 6" in such a way as to form a single body with the main panel 6".

The internal side of the panel cover 14 supports in turn a square plate 20 with dimensions equal to the panel cover 14, which plate bears a decorative pattern or picture or part of a picture to be displayed. Finally the plate 20 has at the four corners respective apertures which can be entered by the feet 16 of the panel cover 14 before the latter is in turn attached to the main panel 6".

The use of the panel cover enables greater coverage, at most complete, of the modules of the grid structure, and enables a picture or a decoration for display to be removed, recomposed or changed without having to open or disassemble each time the modules of the grid structure.

What is claimed is:

1. An assembly for construction of a grid structure, comprising:

a plurality of magnetically anchorable modules, said modules being disposable along side edges of polygonal areas to define a grid structure of the assembly;

stiffening panels conforming to said polygonal areas of said grid structure; and attachment means for attaching said stiffening panels and said modules to each other, said attachment means being arranged for removably fitting said stiffening panels in corresponding ones of said polygonal areas of said grid structure of the assembly.

2. The assembly according to claim 1, wherein said grid structure comprises elongated ones of said modules having an outer cylindrical surface.

3. The assembly according to claim 1, wherein said grid structure comprises enlongated ones of said modules having an outer polygonal surface.

4. The assembly according to claim 1, wherein said grid structure comprises elongated ones of said modules having at least one longitudinally extending groove, and wherein said stiffening panels have shaped side edges to engage said groove.

5. The assembly according to claim 1, wherein said grid structure comprises elongated ones of said modules having an outer surface, and wherein said stiffening panels are provided with lateral edges that engage the outer surface of said elongated modules of the assembly.

6. The assembly according to claim 5, wherein said elongated modules have an outer cylindrical surface and wherein said stiffening panels are provided with lateral edges having a profile conforming to said outer cylindrical surface.

7. The assembly according to claim 1, wherein said modules are provided with a non-magnetic covering matrix.

8. The assembly according to claim 1, wherein said grid structure comprises elongated ones of said modules each including at least one magnet.

9. The assembly according to claim 8, wherein said grid structure comprises elongated ones of said modules each including a magnet at each end.

10. The assembly according to claim 8, wherein said modules each include at least one magnet and a ferromagnetic element.

11. The assembly according to claim 10, wherein said ferromagnetic element is a sphere or polyhedral shaped element.

12. The assembly according to claim 1, wherein said grid structure comprises elongated ones of said modules each including a magnet at each end, and a ferromagnetic element axially extending between the magnets of the elongated modules of the assembly.

13. The assembly according to claim 1, wherein said stiffening panel is made of a material selected from the group consisting of lightweight metal, plastic and wood material.

14. The assembly according to claim 1, wherein at least one of said stiffening panels comprises a cover panel removably connectable to said one stiffening panel.

15. The assembly according to claim 14, wherein said cover panel extends beyond edges of said one stiffening panel.

16. The assembly according to claim 14, wherein a decorative pattern is attached to said cover panel.

17. The assembly according to claim 14, wherein said cover panel is made of transparent material, and a decorative pattern is positioned inside between said panel cover and said one stiffening panel.

18. A assembly for construction of a grid structure, comprising:

plural corner members and plural connecting members that are magnetically connected to respective ones of said corner members to form a hollow grid structure, wherein a first set of said corner members and said connecting members define a planar polygonal area of said hollow grid structure, and wherein sides of said connecting members of said first set that face said polygonal area have recesses therein; and a polygonal panel removably attached in said polygonal area, edges of said panel being removably fitted within respective ones of said recesses to stabilize said hollow grid structure.

* * * * *